United States Patent [19]

Roberts

[11] 4,134,757

[45] Jan. 16, 1979

[54] METHOD OF TREATING MOLTEN METAL

[75] Inventor: Maurice Roberts, Reigate, England

[73] Assignee: Materials & Methods Limited, Surrey, England

[21] Appl. No.: 820,332

[22] Filed: Jul. 29, 1977

[30] Foreign Application Priority Data

Feb. 23, 1977 [GB] United Kingdom ..... 7576/77

[51] Int. Cl.[2] ..... C21C 7/00

[52] U.S. Cl. ..... 75/130 R; 75/53; 75/130 A; 75/130 B

[58] Field of Search ..... 75/130 R, 130 A, 130 B

[56] References Cited

U.S. PATENT DOCUMENTS

| | | | |
|---|---|---|---|
| 3,703,922 | 11/1972 | Dunks | 75/130 R |
| 3,819,365 | 6/1974 | McCaulay | 75/130 R |
| 3,870,512 | 3/1975 | Lee | 75/130 B |
| 4,040,821 | 8/1977 | Hetke | 75/130 A |

*Primary Examiner*—P. D. Rosenberg

*Attorney, Agent, or Firm*—Armstrong, Nikaido, Marmelstein & Kubovcik

[57] ABSTRACT

This invention relates to a method for the treatment of molten metal by introduction of a reactive additive and particularly to the treatment of molten iron by introduction of a nodularizer. The molten metal is introduced into a reaction chamber through one or more slots formed in one or more sides of the chamber thereby producing a cascade of molten metal which flows downwardly into the chamber. The reactive additive is added above the cascade and is rapidly drawn under the molten metal by the flow of the cascade.

5 Claims, 8 Drawing Figures

METHOD OF TREATING MOLTEN METAL

This invention relates to a method for the treatment of molten metal by introduction of a reactive additive.

In particular, the invention relates to a method of treating a stream of molten iron in which the carbon is in flake graphite form to convert the flake graphite iron to nodular graphite iron.

In the manufacture of the so-called nodular or spheroidal graphite cast irons, a base cast iron composition is treated with suitable nodularizers such as Mg, Ca, Na, Li, Sr, Ba, Ce, Dy, La and Y, or alloys or compounds of these metals. These treatment materials are highly reactive and they are either readily oxidisable at the temperatures of the molten cast iron or they are volatile and hence present difficulties in regard to the obtaining of reliable and efficient recoveries on treatment of the molten metal. As these nodularizer materials are very expensive, inefficient treatment is most undesirable, and many processes have been devised to introduce such materials into molten cast iron in which it has been the aim to avoid excessive loss of the nodularizer through either oxidation or volatilisation and to achieve as high a utilization of the treatment agent as possible. Among the methods heretofore employed have been the addition of the nodularizing agent with the assistance of gas agitation, the plunging of the nodularizer into the molten cast iron and the use of sub-surface injection techniques introducing the nodularizer via a graphite or refractory lance. All of these processes suffer certain limitations, for example, in some instances the reliability of the treatment is poor and this leads to a tendency to 'over-treatment'.

Apart from the unnecessary alloy costs involved in over-treatment, hard and brittle castings may be formed because the nodularizer materials are carbide stabilisers and if used in excess lead to deleterious properties in the casting. Also, use of an excess of the nodularizing agents gives rise to the formation of oxides and/or silicates which become entrapped in the melt and produce dirty castings or dross defects, and may lead to the formation of sub-surface blow holes and 'elephant' skin and intensify shrinkage of the molten iron during solidification giving rise to shrinkage defects. In other processing procedures, whilst a degree of reliability can be achieved, elaborate and expensive equipment is required, and even then the utilisation of nodularizer in the iron is seldom greater than 40%.

U.S. Pat. No. 3,819,365 describes a process for the introduction of a reactive additive into molten metal which comprises transferring molten melt from a vessel for the molten metal by way of a reaction chamber provided with an inlet for the molten metal and an outlet for the molten metal which reaction chamber contains the reactive additive and is so designed as to ensure that, for a given flow rate of the molten metal, sufficient molten metal is always present in the chamber at least to cover the additive.

The process described and claimed in U.S. Pat. No. 3,819,365 has been found to produce very satisfactory results under certain processing conditions but it has since become evident that in certain circumstances there are disadvantages attached to the process. In particular, the size of the reaction chamber is largely fixed by the treatment conditions and by the properties of the metal being treated, and therefore a range of treatment apparatus incorporating reaction chambers of different sizes is required for use under a variety of conditions. Also in the process of U.S. Pat. No. 3,819365 there is a possibility of gas pressure building up in the treatment unit owing to vapourization of the reactive additive, and this can cause the molten metal to be blown back out of the apparatus through the entry channel even against a pressure head of the metal trying to maintain the flow. This problem can be particularly severe where the treatment unit has been continuously used over a period of time and becomes very hot so that vapourization of the reactive additive in the chamber is increased.

It is believed that a reason for this problem is that in the kind of treatment unit described previously a relatively deep reaction chamber is used with the inlet and outlet being at the top of the chamber. In such a chamber, whilst flow occurs readily across the upper portion of the chamber between the inlet and the outlet in parts of the chamber which are remote from the upper portion, the molten metal may become static. We have found that the avoidance of such zones of static metal in the reaction chamber is important in avoiding the problem of back pressure created by vapourisation of the additive, and that, provided the whole body of metal is flowing, the gas or vapour formed is swept out of the unit and does not build up.

Copending U.S. application Ser. No. 729,154 provides one method by which the disadvantages of the previous processing methods are reduced or avoided by virtue of the fact that the molten metal to which the additive is to be added is caused to assume a vortex and the additive is added from above either to the vortex or to the metal stream entering the vortex. In its simplest from the vortex is created by running the molten metal into a chamber at an angle to the vertical axis thereof, so that the incoming flow to the chamber induces the vortex in the metal in the chamber and the additive is dropped onto the metal in the vortex or into the stream entering the chamber. It is a feature of the invention described in UK Application No. 44155/75 that the apparatus in which the treatment is carried out is sealed from the atmosphere, for example by the provision of a cover which fits on the top of the chamber unit and seals the unit and through which the additive is fed onto the metal stream.

The present invention provides another method of reducing or obviating the problems of the previous processing methods which does not require the formation of a vortex.

The present invention provides a process for the treatment of molten metal by introduction of a reactive additive into the molten metal which comprises introducing said molten metal into a reaction chamber through at least one entry channel which overlaps with a side of the reaction chamber to provide at least one slot opening into the chamber over at least a substantial portion of the length of the side of the chamber, causing the molten metal to flow through said slot thereby producing at least one cascade which flows downwardly into said chamber, introducing said reactive additive to said chamber above the cascade whereby said additive is rapidly drawn under the molten metal by the flow of the cascade, and recovering the treated molten metal.

Generally, the reaction chamber has a rectangular horizontal cross section and preferably two or more slots are provided.

In the case of two slots, these are preferably arranged at opposite sides of the chamber. Molten metal is caused to flow through horizontal channels which overlap the sides of the reaction chamber thereby providing slots which preferably extent the length of the sides of the chamber.

In the embodiment wherein two slots are provided at opposite sides of the reaction chamber molten metal is caused to flow through the horizontal channels which for at least part of their length extend parallel to opposite sides of the reaction chamber.

Molten metal flowing along a horizontal channel is thus caused to cascade sideways relative to the channel into the reaction chamber. A similar cascade is produced on the opposite side of the chamber and the two cascades flow together and combine in the chamber. A reactive additive is added above the two cascades and the flow of molten metal in the cascades is such that the additive is rapidly drawn into or sucked under the molten metal.

According to another embodiment, a horizontal channel opens out into a widened channel which overlaps with the reaction chamber to form a slot. In this case molten metal flows through the horizontal channel, via the widened portion of the channel into the reaction chamber without change in direction. The molten metal flowing through the slot then falls substantially vertically downwards. This arrangement may be particularly convenient where there is provided only one slot or three slots but can also be employed where there are, for example, two or four slots.

Preferably, the horizontal channels do not completely overlap with the reaction chamber. Thus it is preferred that the channels overlap with the chamber for only a fraction of their width but over the whole or substantially the whole of the length of a side of the chamber. This arrangement provides a weir or dam effect whereby the width of the slots controls the flow rate of the molten metal.

Conveniently, the apparatus is assembled in two parts with the channels in the top pieces or cope overlapping with the reaction chamber in the bottom piece or drag thereby forming the slots.

This invention also provides an apparatus for use in the process for the treatment of molten metal by introduction of a reactive additive into said stream comprising a reaction chamber, an entry channel adapted to introduce the molten metal which overlaps with the reaction chamber to provide a slot opening into the chamber over the whole or a substantial portion of the length of a side of the chamber, means for adding a reactive additive to the molten metal arranged above said slot and an exit channel for the treated metal.

A preferred embodiment of the apparatus is now described. Molten metal is introduced into a loose pouring cup which may, for example, be arranged above the cope or, in another embodiment, sunk into the cope with the top of the pouring cup flush with the top of the cope. Two parallel channels extend vertically downwards from the pouring cup and are angled to provide two parallel horizontal channels which lie parallel to opposite sides of a reaction chamber having a rectangular, horizontal cross section. The horizontal channels overlap with the reaction chamber thereby providing slots extending over the length of the sides of the chamber and located at about the midpoint of the depth of the chamber. The horizontal channels are closed at the ends remote from the pouring cup. The reaction chamber is provided with a centrally mounted hopper located at the top of the chamber for addition of a reactive additive. The lower part of the reaction chamber is tapered and is provided with an exit channel to lead the treated metal out of the apparatus optionally via a spinner.

In the apparatus of this invention the slots through which the molten metal cascades into the chamber are located above the exit from the chamber so that a head of liquid metal can be established under operating conditions. As a result of this there is a continuous flow of metal through the chamber and this minimises the risk of any of the metal becoming static and thereby allowing the generation of a back pressure on reaction with the additive.

To produce the desired head of liquid metal in the chamber, it has further been found to be advantageous to choke the flow of metal through the apparatus at points in the flow path before and after the chamber. This ensures that a steady and progressive flow of the whole of the metal takes place through the apparatus.

In a preferred arrangement of the apparatus of the invention, the flow path for the metal inside the apparatus which follows the chamber and leads to the exit from the apparatus is extended to increase the time available for the reaction of the additive with metal and conveniently this extended path is provided with a first and second sump in each of which a head of metal can be maintained by restricting the area of the exit from each sump. Specifically the area of the choke at the outlet from the first sump is preferred to be equal to the area of the coke at the inlet to the chamber, and thereby like pressure heads are maintained at these points which ensure a smooth continuous flow of metal through the chamber itself. In order to cause a metal head to be initially set up in the chamber at the commencement of a treatment run the limiting choke for the whole apparatus is provided next to the outlet from the apparatus at the point of outflow from the second sump and it has been found particularly suitable to fix the area of this choke at 10% less than the area of the choke at the outlet from the first sump. This ensures that the metal to some extent 'backs up' in the system, but by a proper design of the sumps no portion of the metal flow is allowed to become static. When metal is flowing through the apparatus, shortly after starting a run, a steady state is set up, the pressure heads of the metal above each choke automatically adjusting themselves to a state where the rate of metal flow at all points in the apparatus is the same. It can thus also be seen that, if for any reason a fluctuation in the metal flow occurs, the provision of the sumps with a head of metal in each will allow of ready absorption of such a fluctuation. The flow of metal through the apparatus is thus both smooth and controlled.

The reactive additive is conveniently fed into the chamber at the desired rate relative to the metal flow rate from a hopper situated above the chamber or above the slots which open into the chamber.

In the preferred case where there are two opposite cascades of molten metal the additive is introduced above and between the two converging cascades and is very rapidly drawn into the metal by the force of the cascading metal.

It has been found most convenient to space the hopper at some distance above the point where the additive falls onto the metal and to allow the additive to fall freely down a tube into the chamber or into the metal inlet to the chamber. This prevents the additive in the hopper from becoming too hot by being too close to the molten metal and from fusing to a mass as a result. The introduction of the reaction additive may be controlled automatically by means of a suitable valve situated in the outlet from the hopper.

According to the present invention, the slots control the flow of molten metal into the reaction chamber. It is convenient in the manufacture of the apparatus to assemble it in two parts comprising a bottom piece and a cope. The upper part of the reaction chamber formed in the cope has a rectangular cross section. The horizontal channels can be formed at the bottom of the cope overlapping with the reaction chamber to form slots. The lower part of the reaction chamber in the bottom piece of the apparatus is tapered and is provided with an exit channel leading out of the apparatus via a spinner.

The arrangement of the slots whereby molten metal is caused to flow substantially horizontally and then sideways to cascade into the reaction chamber producing a "waterfall" effect enables a reactive additive introduced from above to be very rapidly drawn into the molten metal. This has considerable commercial importance.

We have found that the process according to this invention has the advantages that a reactive additive can be rapidly introduced into molten metal with the absence of flare and with an improved yield of reactive additive. The formation of cascades of molten metal ensures that the reactive additive is rapidly drawn under the metal. Very little additive is therefore, lost due to vapourisation and this has the further advantage that there is no built up of pressure at the point of addition of the additive. Moreover, since the reactive additive is so rapidly sucked under the molten metal by the force of the cascades there is no blockage of reactive additive at the addition point.

We have also found that the process according to the present invention permits the use of a finer grading of reactive additive which goes into solution faster in the molten metal.

The invention is further illustrated with reference to the accompanying drawing wherein.

Figure 1:
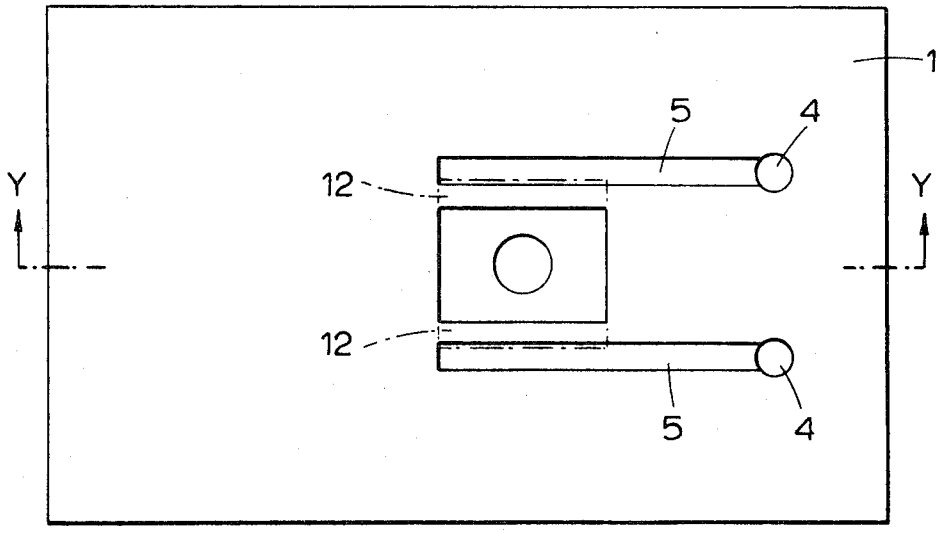
FIG. 1 is a plan view of one embodiment of a cope (top-piece) for an apparatus according to the invention.
Figure 2:
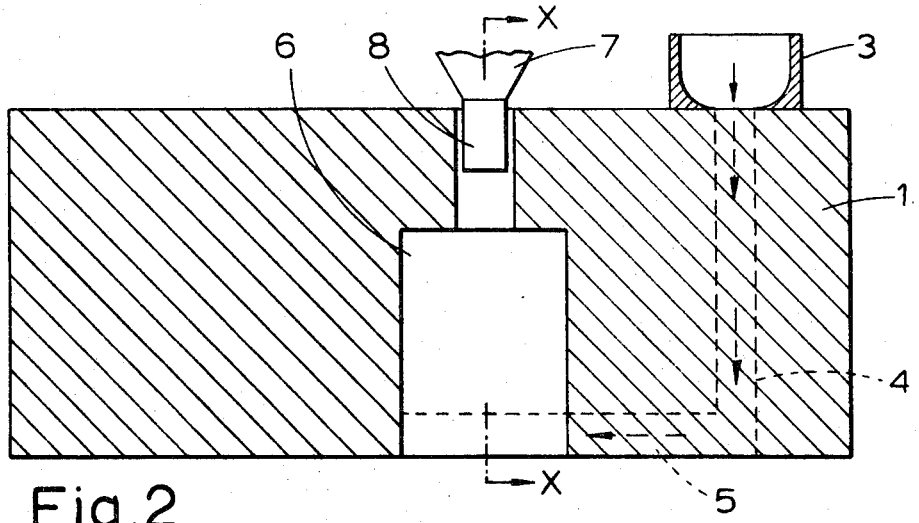
FIG. 2 is a longitudinal section along the line Y—Y of FIG. 1.
Figure 3:
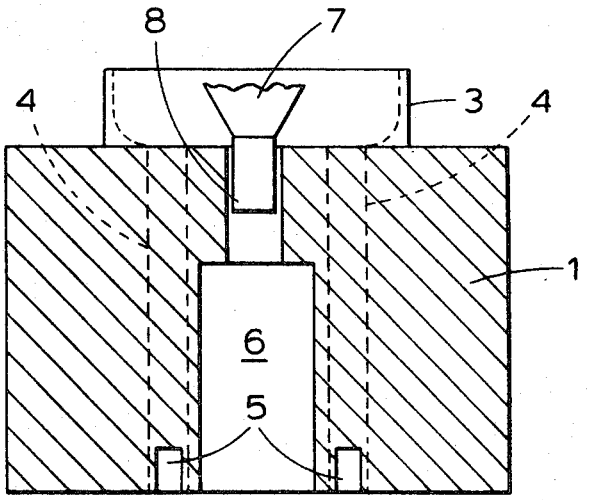
FIG. 3 is a transverse section along the line X—X of FIG. 2.
Figure 4:
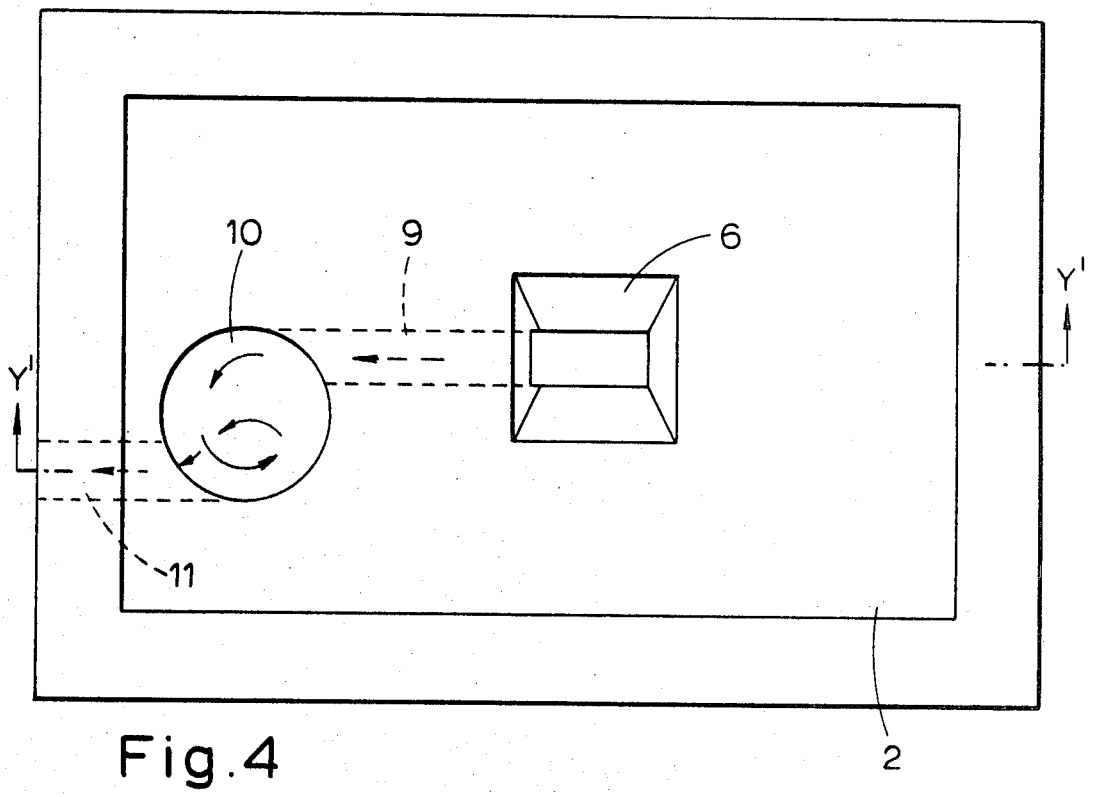
FIG. 4 is a plan view of the drag (bottom piece) of an apparatus adapted to the cope illustrated in FIGS. 1 to 3.
Figure 5:
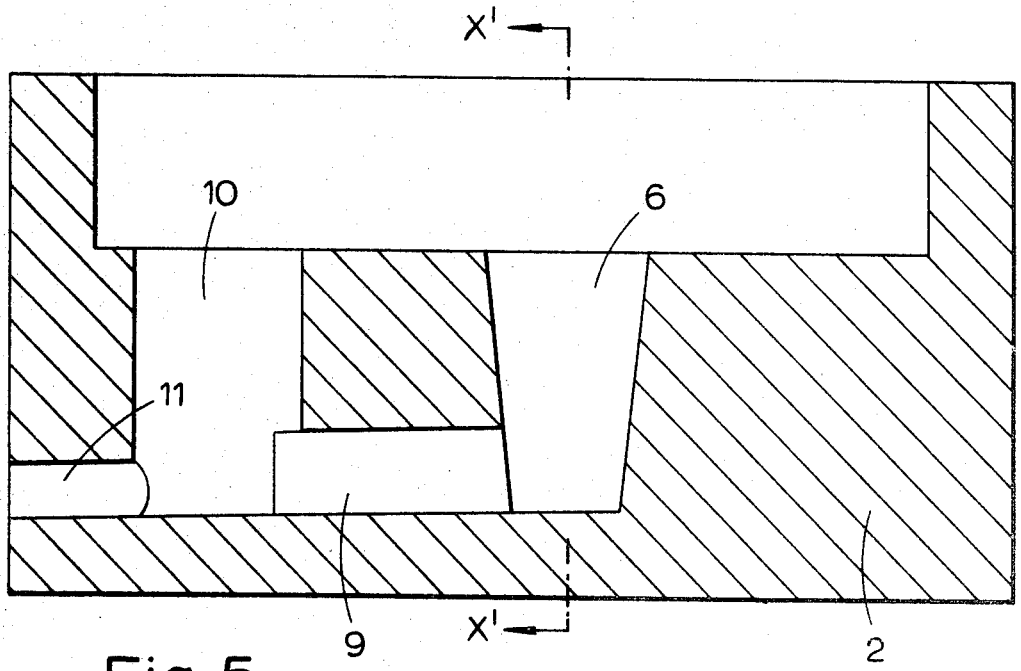
FIG. 5 is a longitudinal section along the line Y—Y of FIG. 4.
Figure 6:
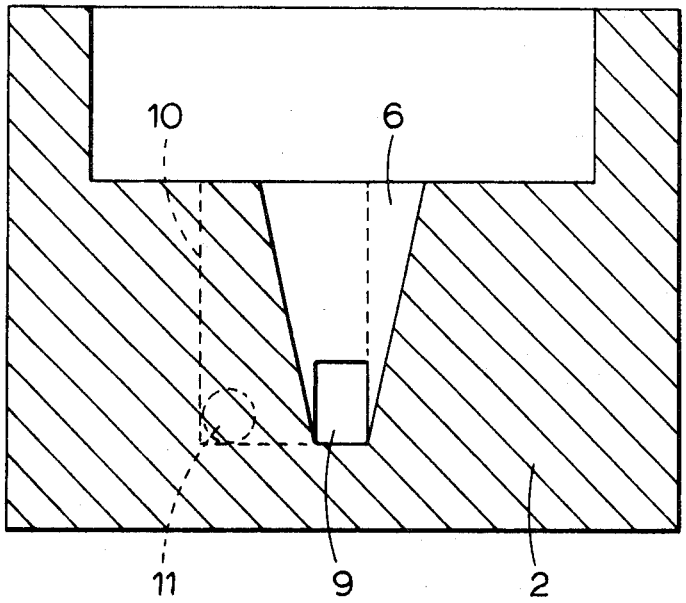
FIG. 6 is an end view along the line X—X of FIG. 5.

The apparatus is assembled in two parts comprising a cope 1 or top piece and a drag or bottom piece 2. The cope or top piece 1 as shown in FIGS. 1 to 3 is provided wih a loose pouring cup 3 for the molten metal. Two vertical channels 4 extend from the cup 3 and are angled to provide horizontal channels 5 extending parallel to each other and to opposite sides of a reaction chamber 6. A centrally mounted automatic hopper 7 is provided for controlled introduction of a reactive additive, through a tube 8 into the chamber 6.

In the bottom piece or drag 2 of the apparatus the reaction chamber 6 is tapered leading to a lower channel 9, a spinner 10 and exit channel 11 through which the treated molten metal is expelled. The reaction chamber 6 in the drag 2 has a greater width in the transverse direction so that when the cope 1 is placed in position on the drag 2 the horizontal channels 5 overlap with the chamber 6 to provide slots 12 at opposite sides of the reaction chamber.

In operation molten metal is introduced via the loose pouring cup 3 and flows via the channels 4 into the horizontal channels 5. The molten metal flows along the horizontal channels and cascades sideways through the slots 12 into the reaction chamber 6. Two converging cascades of molten metal are produced which combine in the chamber 6. A reactive additive is introduced from the hopper 7 and is rapidly drawn under the cascades of molten metal. The molten metal containing the additive leaves the reaction chamber via channels 9, spinner 10 and exit channel 11.

Figure 7:
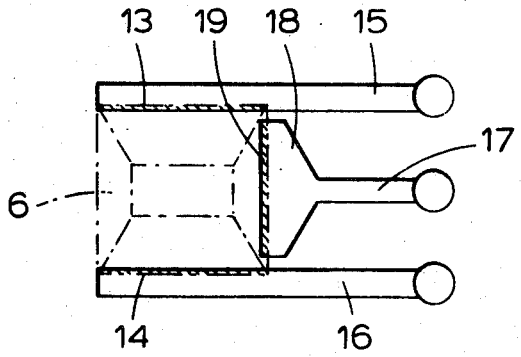
FIG. 7 is a detail of a plan view of a second embodiment of a cope.

FIG. 7 illustrates an embodiment of the apparatus wherein three slots open into the reaction chamber. In this embodiment horizontal portions of channels 15 and 16 extend substantially parallel to opposite sides of the reaction chamber 6 and overlap therewith to provide two slots 13 and 14 located at opposite sides of the reaction chamber. A third horizontal channel 17, extending substantially parallel to the channels 15 and 16, opens into a widened portion 18 which overlaps with a third side of the reaction chamber to provide a third slot 19 which opens into the reaction chamber 6 over a substantial portion of the length of one side of the chamber.

Figure 8:
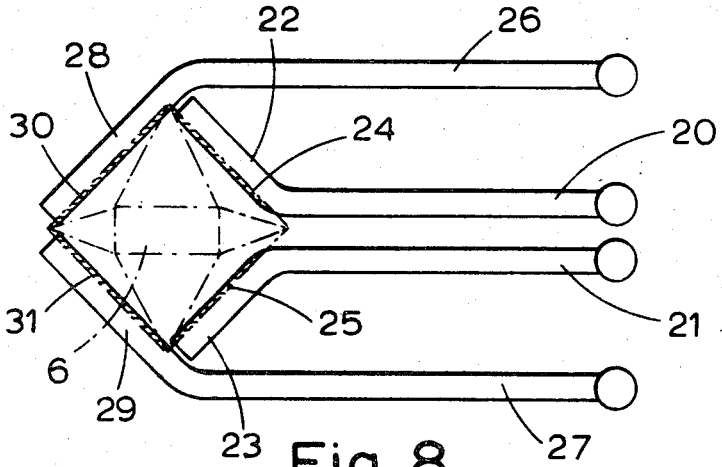
FIG. 8 is a detail of a plan view of a third embodiment of a cope.

FIG. 8 illustrates another embodiment of the apparatus wherein four slots open into the reaction chamber. According to this embodiment two channels 20 and 21 extend parallel to each other over a portion of their length and are angled to provide two channel portions 22 and 23 which extend substantially parallel to adjacent sides of a reaction chamber 6. The channel portions 22 and 23, overlap with the chamber 6 to provide two slots 24 and 25 at right angles to each other opening into the chamber 6. Two further channels 26 and 27 extend parallel to each other over a portion of their lengths arranged on either side of the channels 20 and 21. The channels 26 and 27 are angled to provide two channel portions 28 and 29 which extend substantially parallel to adjacent sides the chamber 6 and overlap therewith to provide two slots 30 and 31 opening into the chamber 6 and at right angles to each other.

I claim:

1. A process for the treatment of molten metal by the introduction of a reactive additive into the molten metal which comprises introducing said molten metal into a reaction chamber through at least one entry channel which overlaps with a side of the reaction chamber to provide at least one slot at the end of said entry channel opening into the chamber over at least a substantial portion of the length of the side of the chamber above the bottom thereof, causing the molten metal to flow through said slot thereby producing at least one cascade of molten metal which flows downwardly into said chamber, introducing said reactive additive into said chamber above the cascade whereby said additive is rapidly drawn under the molten metal by the flow of the cascade, and recovering the treated molten metal.

2. A process according to claim 1, which comprises introducing said molten metal into a reaction chamber having a rectangular horizontal cross-section.

3. A process according to claim 2, wherein said at least one slot is two slots provided at opposite sides of the reaction chamber and said molten metal is introduced into said reaction chamber through said two slots.

4. A process according to claim 1, wherein said at least one slot which extends the length of the side of said reaction chamber and said molten metal is introduced into said reaction chamber through said at least one slot.

5. A process according to claim 1, wherein said molten metal is molten iron and wherein said reactive additive is a nodularizer selected from Mg, Ca, Na, Li, Sr, Ba, Ce, Dy, La and Y and alloys and compounds thereof.

* * * * *